US006762313B2

(12) United States Patent
Strube et al.

(10) Patent No.: US 6,762,313 B2
(45) Date of Patent: Jul. 13, 2004

(54) PROCESSES FOR PREPARING LINOLEIC ACID RAW MATERIALS FOR SUBSEQUENT CONJUGATION

(75) Inventors: Albert Strube, Neuss (DE); Uwe Hoemmerich, Duesseldorf (DE); Bernhard Gutsche, Hilden (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 10/380,564

(22) PCT Filed: Sep. 8, 2001

(86) PCT No.: PCT/EP01/10377

§ 371 (c)(1),
(2), (4) Date: Mar. 13, 2003

(87) PCT Pub. No.: WO02/22768

PCT Pub. Date: Mar. 21, 2002

(65) Prior Publication Data

US 2003/0181522 A1 Sep. 25, 2003

(30) Foreign Application Priority Data

Sep. 18, 2000 (DE) ..... 100 46 402

(51) Int. Cl.[7] ..... C11C 1/00

(52) U.S. Cl. ..... 554/167; 554/30; 554/126; 554/163; 554/169; 514/558; 514/560

(58) Field of Search ..... 554/30, 124, 163, 554/167, 164; 514/558, 560

(56) References Cited

U.S. PATENT DOCUMENTS 6,015,833 A * 1/2000 Saebo et al. ..... 514/558

FOREIGN PATENT DOCUMENTS

| | | | |
|---|---|---|---|
| DE | 41 24 517 A1 | | 1/1993 |
| EP | 0 535 290 B1 | | 4/1993 |
| EP | 0 579 901 B1 | | 1/1994 |
| EP | 0 902 082 B1 | | 3/1999 |
| WO | WO 94/16690 A1 | | 8/1994 |
| WO | WO 96/06605 A1 | | 3/1996 |
| WO | WO 97/18320 A1 | | 5/1997 |
| WO | WO99/47135 | * | 9/1999 |
| WO | WO 99/47 135 A1 | | 9/1999 |

OTHER PUBLICATIONS

Database WPI Section Ch, Week 198247 Derwent Publications Ltd., London, GB; Class E17, AN 1982–02267J XP002189019 & ZA 8 106 488 A (Chem Services Ltd), Jul. 28 1982.

Nutrition, vol. 19, No. 6, (1995) (Reciting entire book –not enclosed).

Ha et al., "Anticarcinogens from fried ground beef: heat–altered derivatives of linoleic acid", Carcinogenesis, vol. 8, No. 12, (1987), pp. 1881–1887.

Schultz et al., "Inhibitory effect of conjugated dienoic derivatives of linoleic acid and B–carotene on the in vitro growth of human cancer cells", Cancer Letters, vol. 63, (1992), pp. 125–133.

Lee et al., "Conjugated linoleic acid and atherosclerosis in rabbits", Atherosclerosis, vol. 108, (1994), pp. 19–25.

* cited by examiner

*Primary Examiner*—Deborah Carr
(74) *Attorney, Agent, or Firm*—Aaron R. Ettelman

(57) ABSTRACT

Processes for preparing linoleic acid raw materials are described wherein the processes comprise: (a) transesterifying a triglyceride component with an alcohol having from 1 to 4 carbon atoms, at a temperature of from 80 to 120° C., to form a transesterification mixture comprising linoleic acid esters and one or more by-products selected from the group consisting of glycerides, free glycerol, and soaps, wherein the triglyceride component is comprised of at least 60% by weight linoleic acid; and (b) removing the one or more by-products from the transesterification mixture.

17 Claims, No Drawings

PROCESSES FOR PREPARING LINOLEIC ACID RAW MATERIALS FOR SUBSEQUENT CONJUGATION

BACKGROUND OF THE INVENTION

Polyunsaturated ω-3 and ω-6 fatty acids, such as α-linoleic acid and linoleic acid, are among the fatty acids essential to mammals and human beings. Besides linoleic acid, other isomeric octadecadienoic acids occur in nature. They are distinguished by conjugated double bonds at carbon atoms 9 and 11, 10 and 12 and 11 and 13. These isomeric octadecadienoic acids are collectively referred to in the scientific literature as conjugated linoleic acids (abbreviation: CLAs) and have recently attracted increasing attention (*NUTRITION,* Vol. 19, No. 6, 1995).

Various working groups have reported on the significance of CLAs to the organism. Recently, Shultz et al. reported on the inhibiting effect on the in-vitro growth of human cancer cells (*Carcinogenesis* 8, 1881–1887 (1987) and *Cancer Lett.* 63, 125–133 (1992)). In addition, CLAs have a strong antioxidative effect so that, for example, the peroxidation of lipids can be inhibited (*Atherosclerosis* 108, 19–25 (1994)).

The use of conjugated linoleic acid in animal feeds and, in this connection, also in human nutrition is known, for example, from WO 96/06605. EP 0 579 901 B relates to the use of conjugated linoleic acid for avoiding loss of weight or for reducing increases in weight or anorexia caused by immunostimulation in human beings or animals. WO 94/16690 is concerned with improving the efficiency of food utilization in animals by administering an effective quantity of conjugated linoleic acid.

CLA is obtained by so-called conjugation of intermediate products containing linoleic acid, i.e. products containing a carboxylic acid function with 18 carbon atoms and 2 double bonds in the 9- and 12-position which are both present in the cis-configuration. It is important during the conjugation reaction to ensure that only the two CLA main isomers (9cis, 11trans and 10trans, 12cis), of which the effect is described in the literature cited above, are formed. An isomer mixture like the CLA used for industrial purposes, for example in paint manufacture (for example Edenor® UKD 6010, a product of Cognis, Düsseldorf), is not wanted.

Pure CLA is often obtained by saponification of oils containing linoleic acid [WO 96/06605, EP 0 902 082 A1]. The disadvantage of these processes lies in the high level of unwanted isomers. These unwanted isomers can be separated by enzymatic esterification, as described in WO 97/18320. In order better to control the isomer content, the corresponding esters may also be used as intermediates. It is known that the corresponding esters can be produced by esterification of the fatty acids with methanol or ethanol. According to the literature, the methyl and ethyl esters of linoleic acid are particularly suitable starting materials for gentle conjugation [WO 99/47135]. There is no known reference to the particular suitability of any of the methods for producing methyl or ethyl linoleate in high purity with regard to the 9cis, 12cis-configuration. WO 99/47135 describes a process for the production of conjugated linoleic acid by esterification or transesterification under nonaqueous conditions in which the alkyl ester obtained is subsequently isomerized in another step.

Another problem in the production of CLA or CLA intermediates is that, hitherto, the necessary reduction in the C16 content and the simultaneous increase in the C18:2 content could not be achieved without fractional distillation in a column for the total quantity of crude ester. Instead, only part of the reactor contents is fractionated towards the end of distillation of the main fraction, with the result that the yields are unsatisfactory.

The problem addressed by the present invention was to provide raw materials for the production of conjugated linoleic acid (CLA), such as methyl or ethyl linoleate for example, from intermediate products rich in linoleic acid, with the provisos that ➢ the C16 content would be reduced and the C18:2 content simultaneously increased, ➢ 9cis, 12cis configuration would remain intact to a high degree and ➢ no uncontrolled pre-conjugations or isomerizations would occur during production of CLA raw material, ➢ the process would be economical, i.e. could be carried out with high yields on an industrial scale.

BRIEF SUMMARY OF THE INVENTION

The present invention relates, in general, to food supplements and, more particularly, to a process for the production of raw materials for the production of conjugated linoleic acid.

The present invention relates to a process for the production of raw materials for the production of conjugated linoleic acid, characterized in that (a) triglycerides containing at least 60% by weight of linoleic acid are transesterified with alcohols having a chain length of 1 to 4 carbon atoms at a temperature of 80 to 120° C. and (b) the transesterification mixture thus obtained is subjected to distillation.

To this end, a triglyceride rich in linoleic acid, for example sunflower oil, preferably safflower oil, more preferably refined safflower oil, is transesterified with methanol, preferably ethanol. By comparison with esterification with linoleic acid, it has surprisingly been found that almost no unwanted pre-conjugations and isomerizations occur. The transesterification takes place under gentle conditions, i.e. without the use of inert gas or ethylene or propylene glycol.

DETAILED DESCRIPTION OF THE INVENTION

Transesterification

The fatty acid glycerides to be used as starting materials in accordance with the invention may be the usual natural vegetable or animal fats or oils. These include, for example, linola oil, sunflower oil and, preferably, safflower oil. The principal constituents of these fats and oils are glycerides of various types of fatty acids which contain considerable quantities of impurities, such as for example aldehyde compounds, phospholipid compounds and free fatty acids. These materials may be used either directly or after preliminary purification. They are fatty acid mixtures which contain at least 60%, preferably more than 70% and, more particularly, in excess of 75% by weight of conjugated linoleic acid. The reaction takes place under controlled conditions without the use of inert gas. The reaction is preferably carried out at a temperature in the range from 80 to 120° C., more preferably at a temperature of 85 to 100° C. and most preferably at a temperature of 88 to 95° C. The glycerol formed during the reaction is continuously removed via a coalescence separator and approximately two thirds of the total quantity of catalyst is continuously added during the reaction. Suitable catalysts are alkali metal and/or alkaline earth metal alcoholates or hydroxides, more particularly sodium methanolate and/or sodium glycerate and, in a particularly preferred embodiment, sodium ethylate. The reaction takes place over 4 to 7 hours and preferably over 5 to 6 hours. In the final step of the transesterification, the reaction mixture is neutralized with citric acid. Taking the reaction products preferably used into account, the process is preferably used for the production of a safflorethyl ester with a small content of unwanted isomers.

Distillation

The object of distilling the transesterified reaction mixture is to remove glycerides, free glycerol and soaps. In addition, it leaves the reaction product with a more attractive color. In addition, depending on the raw material, the palmitic acid content can be reduced and the linoleic acid content increased by distillation of the product. Initially, the excess ethanol is distilled off after application of a vacuum of 100 to 300 mbar. Free glycerol additionally accumulating during distillation of the ethanol is removed via the separator. Thereafter, the temperature is increased to 150–200° C. and preferably to 160–180° C. under a vacuum of 1 to 3 mbar. 5 to 10% of the first runnings are removed and the product is distilled to a residue of 5 to 10%. In order to obtain a high yield, fractional distillation may preferably be applied. In addition, in order simultaneously to reduce the C16 content and increase the C18:2 content, it has proved to be of advantage either to carry out a batch distillation from a reactor surmounted by a column, which increases the C16 content in the first runnings distillate, or to carry out distillation in two stages, in which case around 5 to 10% by volume of the first runnings is removed from the fractionating column and the main fraction is distilled via the column head. With the second alternative in particular, the C16 content in the main fraction can be reduced from a starting value of 6.5% by weight to 0.7% by weight, the C18:2 content simultaneously increasing from 75.5% by weight to 81.4% by weight.

Conjugated Linoleic Acid (CLA)

In the context of the invention, conjugated linoleic acid is preferably understood to include the main isomers 9cis, 11trans octadecadienoic acid and 10trans, 12cis and the isomer mixtures which normally accumulate in the production of conjugated linoleic acid. The raw materials produced by the process according to the invention should already contain a high percentage of the preferred isomers.

Commercial Applications.

The process according to the invention is intended for the production of raw materials for the production of conjugated linoleic acid (CLA). The small percentage of unwanted isomers in the crude product saves further isomer separation and purification steps in the production of the CLA. The CLA produced from the raw materials may be used for all the applications already known from the literature for conjugated linoleic acid, for example in foods, preferably so-called functional foods, and in pharmaceuticals, particularly as a supporting agent in the treatment of tumours or even for the treatment of people suffering from catabolic conditions.

EXAMPLES

Example 1 (Transesterification)

The test arrangement for the transesterification consisted of a 2-liter reactor (double jacket) with reflux condenser, coalescence separator in the recycle circuit and vacuum pump. The starting materials used were 1500 g safflower oil, 240 g ethanol, 47 g sodium ethylate in the form of a 20% by weight ethanolic solution (partly added later during the reaction) and citric acid also in the form of a 20% by weight solution in ethanol. The reaction was carried out at ambient pressure. To this end, the oil rich in oleic acid was introduced first and heated to 60° C. and ethanol and about one third of the sodium ethylate were then added. The contents of the reactor were heated to a reaction temperature of ca. 90° C. and the reaction was carried out under reflux. With the circulation pump on (circulation rate 8 l/h), the glycerol phase accumulating was removed during the reaction and ca. 4 g of catalyst solution was continuously added every 30 minutes. The reaction time was 5.5 h. The reaction mixture was then neutralized with citric acid. Glycerides, free glycerol and soaps were removed by distillation. The excess ethanol was removed in a vacuum of 100–300 mbar. In addition, additional free glycerol accumulating during distillation of the ethanol was removed via the separator. The bottom temperature was then raised to 160–180° C. under a vacuum of 1–3 mbar, 5 to 10% of first runnings were removed and then main fraction was then distilled to a residue of 5–10%. The isomers and fatty acid fractions were determined by a chromatographic process. A 120 cm long silica column (120 m×0.25 mm Permabond® FFAP-0.25 μm, supplier: Macherey Nagel) with hydrogen as carrier gas was used. The composition of the product is shown in Table 1:

TABLE 1

Composition of starting oil and distillate fraction (figures = % by weight)

| Isomer | Starting Oil | Distillate fraction |
|---|---|---|
| C16:0 | 6.01 | 0.99 |
| C18:0 | 2.80 | 3.10 |
| C18:1 c9 | 13.25 | 14.31 |
| C18:2 c9, c12 | 74.74 | 76.69 |

Comparison Example C1 (Esterification)

The test arrangement for the esterification (operation on the principle of the bubble reactor) consisted of a heatable 2-liter reactor surmounted by a distillate cooler and trap, bottom temperature measurement and control via a heating mushroom, a submerged nitrogen inlet tube, a glass frit and a Dosimat for the addition of ethanol and a vacuum pump. The starting materials used were 1,000 g sunflower oil fatty acid (Edenor® Sb, Cognis Deutschland GmbH), 1,000 g ethanol (added continuously), 2.5 g p-toluenesulfonic acid and sodium hydroxide in the form of a 6% by weight aqueous solution. The reaction was carried out at ambient pressure. To this end, Edenor® Sb and p-toluenesulfonic acid were initially added to the reactor, nitrogen was continuously introduced through a submerged tube and the contents of the reactor were heated to 170° C. The addition of ethanol at 170 ml/h was started and the termination of the reaction was completed after about 6 h at an acid value of <1 by interrupting the addition of ethanol. The excess ethanol was distilled off and the reactor was cooled to 80° C. After washing with sodium hydroxide (twice the stoichiometric quantity), the product was dried at 200 mbar. The bottom temperature was increased to 160–180° C. under a vacuum of 1–3 mbar, 5–10% of first runnings were removed and the main fraction was then distilled to a residue of 5–10%. The composition of the product is shown in Table 2:

TABLE 2

Composition of starting oil and distillate fraction (figures = % by weight)

| Isomer | Starting oil | Distillate fraction |
|---|---|---|
| C18:1 t9 | <0.05 | 0.49 |
| C18:1 t10 | n.d. | 0.31 |
| C18:1 t11 | n.d. | 0.40 |
| C18:1 c11 | 0.74 | 0.78 |
| C18:2 t9, t12 | 0.06 | 1.54 |
| C18:2, c9, t12 | 0.66 | 1.04 |

Comparison Esterification/Transesterification

Table 3 presents a comparison of the isomers and CLA from the reaction product of the transesterification and the esterification taking into account the different oleic acid/linoleic acid ratio in the raw materials used:

TABLE 3

Comparison transesterification/esterification

| | Safflower ethyl ester by transesterification (invention) | Safflower ethyl ester by esterification (comparison) |
|---|---|---|
| C16/0 | 7.20 | 7.08 |
| C16/1 | 0.05 | 0.16 |
| C18/0 | 2.60 | 2.47 |
| C18/1 9t | n.n. | 0.53 |
| C18/1 10t | n.n. | 0.41 |
| C18/1 11t | n.n. | 0.46 |
| C18/1 9c | 11.99 | 10.08 |
| C18/1 11c | 0.60 | 0.95 |
| C18/2 9t, 12t | 0.03 | 1.77 |
| C18/2 9c, 12t | 1.49 | 1.30 |
| C18/2 9t, 12c | n.n. | 0.56 |
| 018/2 9c, 12c | 75.03 | 73.12 |
| Not identified or > C18 | 1.01 | 1.21 |
| Sum total of unwanted isomers (with t-components) | 1.52 | 4.76 |

What is claimed is:

1. A process for preparing a linoleic acid raw material, said process comprising:

(a) transesterifying a triglyceride component with an alcohol having from 1 to 4 carbon atoms, at a temperature of from 80 to 120° C., to form a transesterification mixture comprising linoleic acid esters and one or more by-products selected from the group consisting of glycerides, free glycerol, and soaps, wherein the triglyceride component is comprised of at least 60% by weight linoleic acid; and (b) removing the one or more by-products from the transesterification mixture.

2. The process according to claim 1, wherein the alcohol comprises methanol.

3. The process according to claim 1, wherein the alcohol comprises ethanol.

4. The process according to claim 1, wherein the glyceride comprises a sunflower oil.

5. The process according to claim 1, wherein the glyceride comprises a safflower oil.

6. The process according to claim 1, wherein the triglyceride component is transesterified in the presence of a catalyst.

7. The process according to claim 6, wherein the catalyst comprises sodium methylate.

8. The process according to claim 6, wherein the catalyst comprises sodium ethylate.

9. The process according to claim 6, wherein the catalyst comprises an alkali metal alcoholate, and wherein the catalyst is continuously added during the transesterification.

10. The process according to claim 9, wherein the catalyst comprises sodium methylate.

11. The process according to claim 9, wherein the catalyst comprises sodium ethylate.

12. The process according to claim 11, wherein the transesterification of the triglyceride component comprises: (i) heating the triglyceride to a temperature of from 50 to 70° C., (ii) adding ethanol and sodium ethylate to the heated triglyceride component to form a reaction mixture, (iii) reacting the triglyceride component and the ethanol under reflux conditions for a period of at least 5 hours with the removal of accumulating glycerol and the continuous addition of catalyst solution, and (iv) neutralizing the reaction mixture.

13. The process according to claim 12, wherein the reaction mixture is neutralized with citric acid.

14. The process according to claim 1, wherein the one or more by-products are removed by distillation.

15. The process according to claim 14, wherein the distillation comprises fractional distillation.

16. The process according to claim 14, wherein the removal of the one or more by-products comprises: (i) distilling the transesterification mixture at a pressure of from 100 to 300 mbar to remove excess alcohol, whereby an intermediate distillation product is formed; and subsequently (ii) distilling the intermediate distillation product to a residue of 5 to 10% under a vacuum of 1 to 3 mbar and at a temperature of 150 to 200° C.

17. A process for preparing a linoleic acid raw material, said process comprising:

(a) transesterifying a triglyceride component with an alcohol selected from the group consisting of methanol and ethanol, in the presence of a catalyst, at a temperature of from 80 to 120° C., to form a transesterification mixture comprising linoleic acid esters and one or more by-products selected from the group consisting of glycerides, free glycerol, and soaps, wherein the triglyceride component is comprised of at least 60% by weight linoleic acid and is selected from the group consisting of sunflower oils and safflower oils, and wherein the catalyst comprises an alkali metal alcoholate; and (b) removing the one or more by-products from the transesterification mixture by fractional distillation.

* * * * *